US009017183B1

(12) United States Patent
Ambrose

(10) Patent No.: US 9,017,183 B1
(45) Date of Patent: Apr. 28, 2015

(54) GOLF PUTTER AND METHOD

(71) Applicant: John M. Ambrose, Jefferson, OH (US)

(72) Inventor: John M. Ambrose, Jefferson, OH (US)

( * ) Notice: Subject to any disclaimer, the term of this patent is extended or adjusted under 35 U.S.C. 154(b) by 203 days.

(21) Appl. No.: 13/723,892

(22) Filed: Dec. 21, 2012

(51) Int. Cl.
*A63B 69/36* (2006.01)
*A63B 53/04* (2006.01)
*A63B 53/06* (2006.01)
*A63B 53/14* (2006.01)

(52) U.S. Cl.
CPC ..... *A63B 53/0487* (2013.01); *A63B 53/04* (2013.01)

(58) Field of Classification Search
CPC ..... A63B 53/0487; A63B 53/04
USPC ..... 473/340, 341, 313, 342, 251–256, 473/300–303, 294, 314, 312, 409, 324; D21/736–746
See application file for complete search history.

(56) References Cited

U.S. PATENT DOCUMENTS

| | | | | | |
|---|---|---|---|---|---|
| 3,077,350 | A * | 2/1963 | Koorland | 473/251 |
| 3,841,640 | A * | 10/1974 | Gaulocher | 473/249 |
| D235,668 | S * | 7/1975 | Swash | D21/739 |
| 3,954,265 | A * | 5/1976 | Taylor | 473/252 |
| 4,934,702 | A * | 6/1990 | Serizawa | 473/251 |
| 5,058,895 | A * | 10/1991 | Igarashi | 473/341 |
| 5,072,941 | A * | 12/1991 | Klein | 473/255 |
| 5,269,518 | A * | 12/1993 | Kobayashi et al. | 473/297 |
| 5,324,031 | A * | 6/1994 | Green | 473/252 |
| 5,544,879 | A | 8/1996 | Collins | 473/314 |
| 5,573,468 | A * | 11/1996 | Baumann | 473/312 |
| 5,601,499 | A * | 2/1997 | Segaline | 473/313 |
| 5,624,329 | A * | 4/1997 | Schneebeli | 473/287 |
| 6,102,814 | A | 8/2000 | Grace et al. | 473/340 |
| 6,217,459 | B1 * | 4/2001 | Purcell | 473/313 |
| 6,238,303 | B1 * | 5/2001 | Fite | 473/342 |
| 6,267,689 | B1 * | 7/2001 | Ambrose | 473/251 |
| 6,350,208 | B1 * | 2/2002 | Ford | 473/249 |
| 6,488,595 | B1 | 12/2002 | Grace | 473/341 |
| 6,723,001 | B2 * | 4/2004 | Ferris | 473/251 |
| 6,796,911 | B2 | 9/2004 | Grace | 473/251 |
| 6,837,801 | B1 * | 1/2005 | Souza et al. | 473/251 |
| 6,896,625 | B2 | 5/2005 | Grace | 473/251 |
| 6,929,559 | B1 | 8/2005 | Grace | 473/251 |
| 6,958,019 | B2 * | 10/2005 | Rohrer | 473/324 |
| 7,048,639 | B2 | 5/2006 | Grace | 473/251 |
| D582,497 | S | 12/2008 | Rollinson | D21/744 |
| 7,922,600 | B1 | 4/2011 | Ambrose | 473/312 |
| 2002/0173377 | A1 * | 11/2002 | Sindelar | 473/340 |
| 2009/0088268 | A1 * | 4/2009 | Elizondo | 473/341 |

* cited by examiner

*Primary Examiner* — Sebastiano Passaniti
(74) *Attorney, Agent, or Firm* — Blake P. Hart

(57) ABSTRACT

An improved putter and method of use utilizing a putter shaft having a rectangular grip extending approximately half the shaft length. A polygonal-like ring provides a flat face with an extended toe and a short heel. The face of the putter head has a polymeric insert for weight redistribution and for better putting feel. The sides of the putter include triangular shaped indents also for weight redistribution. The rear of the putter head is arched to prevent ground contact during putting and further to increase head stability during the stroke.

19 Claims, 4 Drawing Sheets

GOLF PUTTER AND METHOD

FIELD OF THE INVENTION

The invention herein pertains to weighted golf clubs and particularly pertains to a weighted putter that is designed to improve stability and feel by distributing substantial putter weight to the grip and outer edges of the putter head.

DESCRIPTION OF THE PRIOR ART AND OBJECTIVES OF THE INVENTION

Over the years various types and styles of putters have been conceived all in an effort to provide the greatest benefit and lowest score for the golfer. In my previous U.S. Pat. No. 7,922,600, incorporated herein by reference in its entirety, a weight system for golf clubs is disclosed which is helpful to many in obtaining lower scores. The same technology is incorporated herein along with other benefits including weight redistribution, guides and other features to create an enjoyable and successful game for the golfer.

Putting is arguably one of the most important aspects of the game of golf. Consequentially, the putter is one of the most important clubs in a golfer's bag. Although putters continue to demonstrate cosmetic changes in design, their overall construction has emphasized personalized adaptability to the golfer, emphasizing touch and adjustability to each players preferences. Modern putters include elongated shafts (see U.S. Pat. No. 5,544,879), weighted heads (U.S. Pat. No. 7,922,600), and contemporary head designs (U.S. Design Pat. No. 582,497). These designs, and countless others are all made with the intent of enticing the golfer's interest by focusing on personal feel and cosmetic appearances. However, by emphasizing one characteristic over others (i.e. shaft length, head design, limited weight distribution, etc.), prior putters often lose performance at the expense of aesthetics or creating the illusion of personalization. Put another way, making looks and adaptability the primary goal of design results in a lose of club performance. Consequently, the player must either alter his stroke, (i.e. club anchoring such as chest or belly putting), or the physical characteristics of the club, (i.e. lie angle alterations, or limited toe to heel weight distribution), to seek club head stability and an improvement in performance. These personalized, adjustability traits, can lead to instability, a lack of repeatability, inaccuracy, and consequently, a reduced enjoyment of the game.

Thus, in view of the problems and disadvantages associated with prior putters, the present golf club was conceived and one of its objectives is to provide a putter with a head weighing more than six hundred (600) grams, with a toe to heel width in excess of 6", and a grip weighing more than two hundred fifty (250) grams.

It is another objective of the present invention to provide a putter head with the majority of its weight at the outer edges of the head.

It is still another objective of the present invention to provide a putter with a polymeric insert in the face to increase the feel of ball impact necessary to offset the potential deadening effects of the added weight and size.

It is yet another objective of the present invention provide a putter with a face design that produces a sweet spot that extends from the toe of the face to a distance of 3", on a 5" face length.

It is another objective of the present invention to increase the sweet spot size (preferred impact area of the face) in order to increase club performance and stability.

It is yet another objective of the present invention to provide a putter with a grip including a resilient material that extends approximately half the length of the shaft.

It is a further objective of the present invention to provide a putter head defining a hollow polygonal ring.

It is still a further objective of the present invention to provide a putter head having a heel and a toe, the toe having a length greater than the length of the heel and face for proper weight distribution and increased sweet spot in the toe.

It is yet a further objective of the present invention to provide an "S" shaped putter shaft with a hollow section and a weight opening for receiving a weighted threaded rod therein.

It is still a further objective to provide a putter with a large, heavy, head, specially designed to maximize moment of inertia (MCI), substantially increase the size of the club face sweet spot (the most effective contact area for the ball), increase momentum during the stroke for variable energy transfer with minimum muscle use, coupled with a large, heavy grip for overall club balance. This overall size, weight and club balance bypasses the hinging tendencies of the hands, and connects the club head directly to the big muscles of the arms and shoulders for a more repeatable stroke.

It is yet a further objective of the present invention to provide a putter with a flat sole from heel to toe, to create a constant predetermined lie angle at the address position.

It is still a further objective of the present invention to provide a putter with a tapered sole from front to back to increase ground clearance throughout the stroke, and to allow for face loft variations for better distance performance It is a further objective of the present invention to provide a method of putting the ball with a variable weighted putter.

It is still a further objective of the present invention to provide a method of putting the ball with a putter grip having an extended square cross section.

Various other objectives and advantages of the present invention will become apparent to those skilled in the art as a more detailed description is set forth below.

SUMMARY OF THE INVENTION

The aforesaid and other objectives are realized by providing a putter and method of use in which the putter includes a head consisting of a hollow, generally polygonal ring having a hosel, sight guides and weight redistributing indents. The hollowed head allows the weight of the putter to be distributed to the perimeter which stabilizes the motion as it moves through the stroke or moment of inertia and increases the size of the sweet spot on the face at the same time. The face of the putter incorporates a polymeric member which gives the ball more impact feel with the face while also moving more weight to the perimeter of the head for face stability. Drag is eliminated during the putting stroke as an arched rear is joined by arcuate sides to the face of the putter.

The putter grip includes a polymeric member having a rectangular cross section which extends approximately half the length of the smooth, non-stepped shaft. The shaft defines an S-shaped section which is immediately above the hosel for better sight and more desirable lie angle as the ball is addressed. The head and shaft are formed from suitable metals.

The method of use includes adjusting the putter weight through the selection of a suitable weighted member which is then inserted through an opening in the bottom of the head into the hollow shaft section. This weight addition does not have an effect on the center face balance of the head due to its shaft location. Next, the player will grip the putter at a comfortable location along the square grip. The putter is then used to strike the ball for an accurate stroke.

DETAILED DESCRIPTION OF THE PREFERRED EMBODIMENT AND OPERATION OF THE INVENTION

Figure 4:
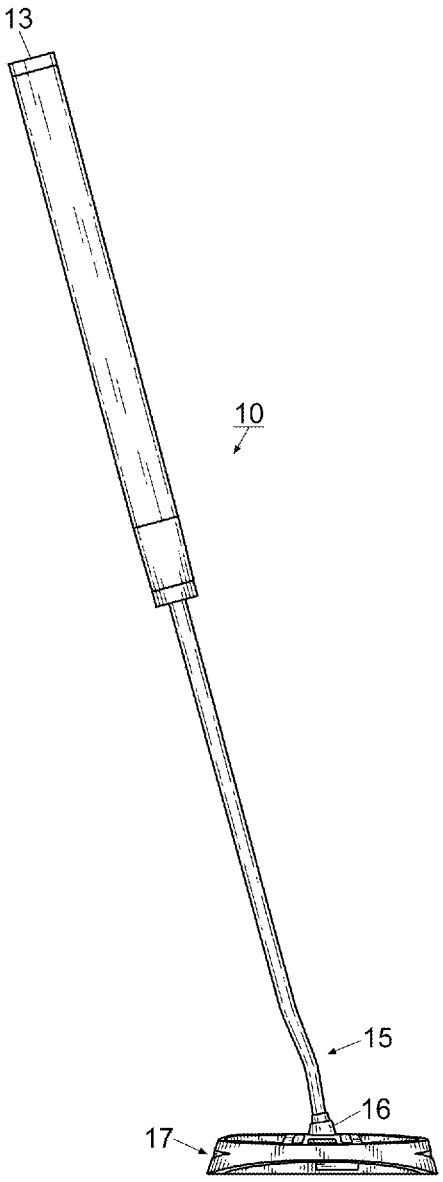
FIG. 4 demonstrates a rear elevational view of the putter as shown in FIG. 1.
Figure 1:
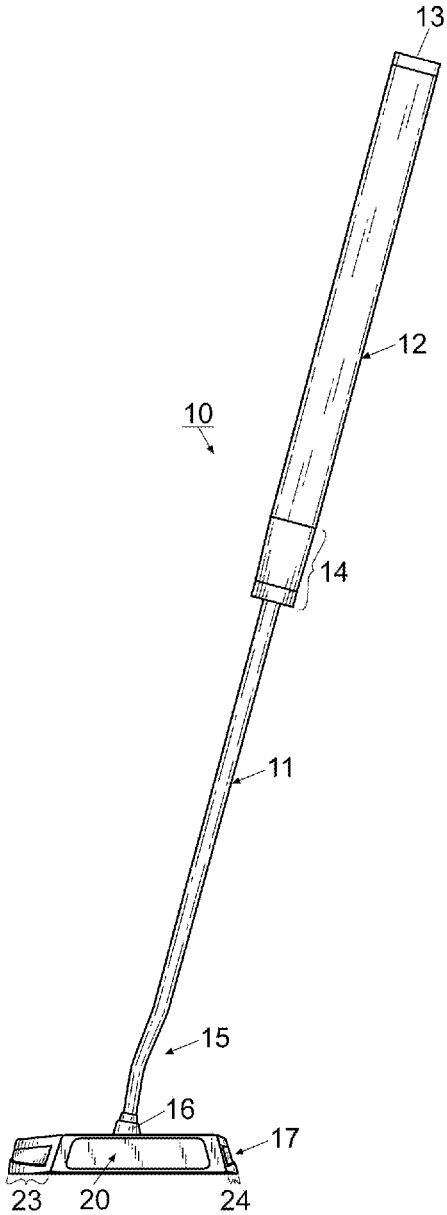
FIG. 1 shows a front elevational view of the preferred putter of the invention.

For a better understanding of the invention and its operation, turning now to the drawings, FIG. 1 shows a front view of preferred putter 10 having shaft 11 and grip 12 which is formed from a standard resilient polymeric foam material. Grip 12 defines a rectangular cross section and includes grip top 13. Grip 12 extends along shaft 11 approximately one half the shaft length and includes a short tapered length 14 at the bottom thereof. Shaft 11 is a conventional shaft preferably formed from metal although other suitable materials such as aluminum, steel, carbon fiber, or other polymeric blends may be utilized. Although preferred golf club 10 is represented in FIGS. 1-9 as a putter, it is understood that club 10 may take on any of a myriad of designs, both of putters and for other clubs.

Figure 7:
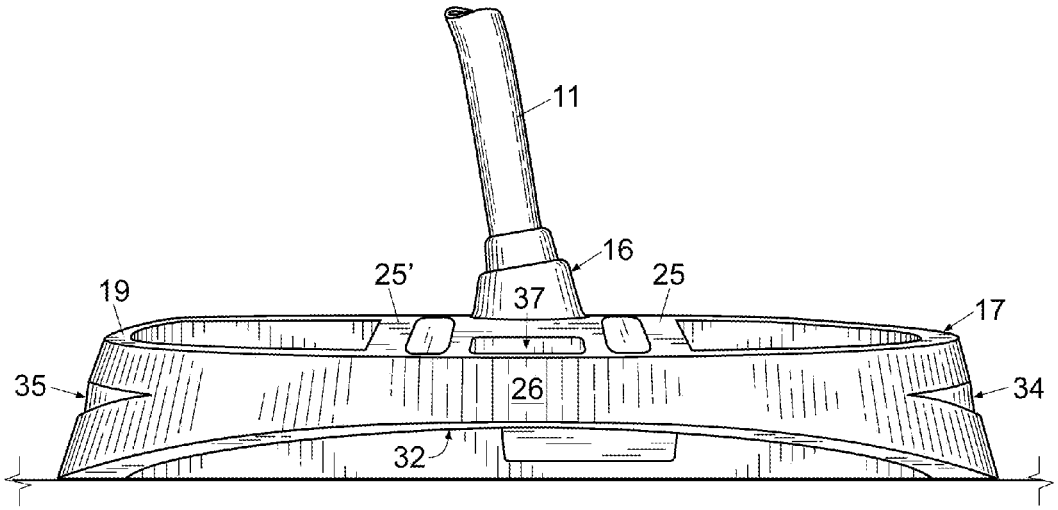
FIG. 7 shows an enlarged rear elevational view of the putter head.
Figure 8:
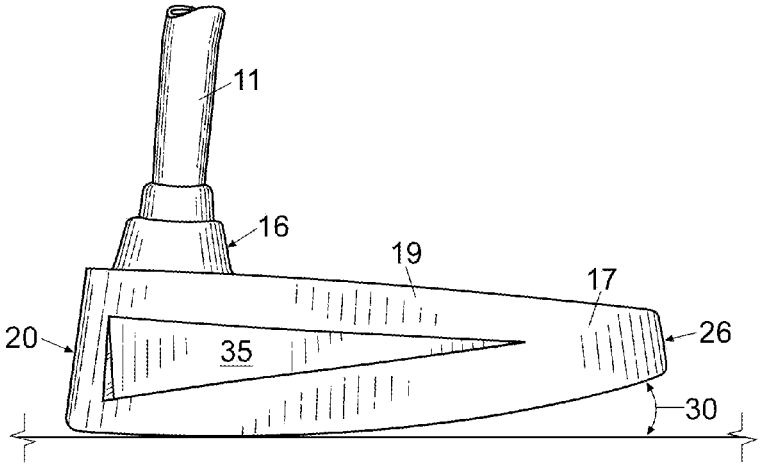
FIG. 8 illustrates an enlarged right side elevational view thereof.

As shown in FIGS. 2, 4, 5 and 6, smooth shaft 11 includes an S-shaped bend (seen generally at 15) immediately above hosel 16. Bend 15 is such that when it connects to head 17 it places face 20 in a center balanced position which helps keep face 20 square up the aim line of the putt throughout the stroke. Bend 15 also assists in how it positions the hands of the golfer (not shown) to be slightly forward of face 20 at address which promotes a slight forward motion as the stroke begins (called a forward press) that helps to push putter 10 back on the initial stroke motion, rather than pull it back with the dominant hand. Hosel 16 is affixed to head 17 as also shown in FIGS. 7 and 8, shaft 11 is inserted into hosel 16 and frictionally engages therewith. This attachment coupled with bend 15 creates a desirable lie angle of approximately seventy four degrees (74°) for preferred putter 10.

Head 17 as shown in FIGS. 3, 5, 7 and 9 comprises generally polygonal hollow ring 19 having flat top 18, biased bottom 27, arcuate side 29, and arcuate rear 26 forming arch 32. Generally polygonal ring 19 includes flat face 20 for striking a conventional golf ball (not shown). This "hollowed" design allows the weight of the putter to be distributed to the outside which stabilizes the motion as club 10 moves through the stroke and increases the size of the "sweet spot" on face 20 at the same time. Specifically, the vertical "sweet spot" remains unchanged but the horizontal "sweet spot" is lengthened to approximately 3 inches (7.62 cm). Face 20 includes indent 21 for receiving flat polymeric plate 22 which is held in place by a suitable adhesive 33. Adhesive 33 may be a conventional epoxy or other suitable adhesive. Plate 22 is formed from a light plastic such as nylon, polypropylene or other suitable polymeric materials. The insertion of plate 22 gives the ball more impact feel with face 20 and with the inclusion of indent 21 more weight is moved to the perimeter of head 17 for stability of face 20.

Figure 2:
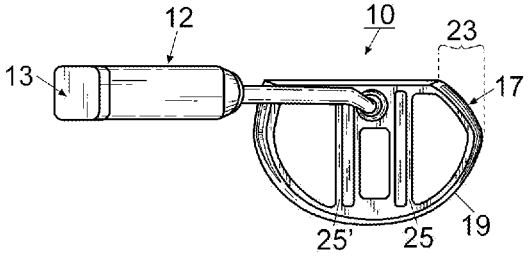
FIG. 2 pictures a top plan view of the putter as shown in FIG. 1.
Figure 3:
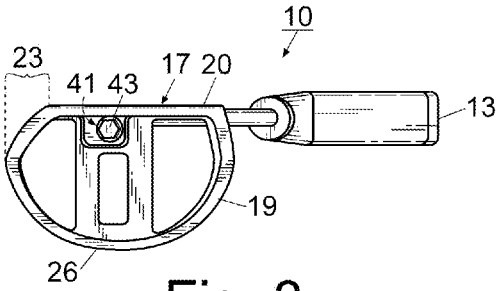
FIG. 3 depicts a bottom plan view of the putter as shown herein.

As further shown in FIG. 1, face 20 is joined to toe 23 and heel 24. As illustrated, toe 23 extends beyond face 20 whereas heel 24 does not, as also shown in FIGS. 2 and 3. This extension, coupled with space between the termination of face 20 and the end of toe 23, is responsible for moving the "sweet spot" further in the direction of toe 23 compared to conventional clubs. Toe 23 may be considered the portion of putter head 17 that extends towards the front of the putter 10 from approximately the attachment point of shaft 11, and may include of portion of putter 10 beyond face 20. Similarly, heel 24 may be considered the portion of putter head 17 which extends towards the rear of putter 10 from approximately the attachment point of shaft 11. Generally polygonal ring 19 is preferably formed from aluminum although other materials may be used. As further seen in FIGS. 2, 3 and 9, ring 19 is substantially hollow with guides 25, 25' spanning ring 19 from face 20 to rear 26. Strips 28, 28' in guides 25, 25' are for sighting when the ball is addressed. Strips 28, 28' may be for example colored white or other suitable colors for contrast and easy viewing.

Figure 5:
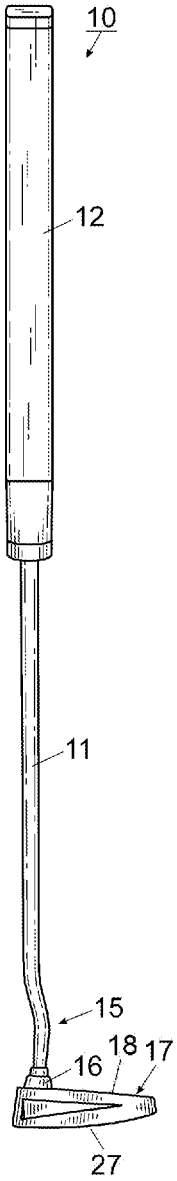
FIG. 5 illustrates a right side elevational view of the putter as shown in FIG. 1.
Figure 6:
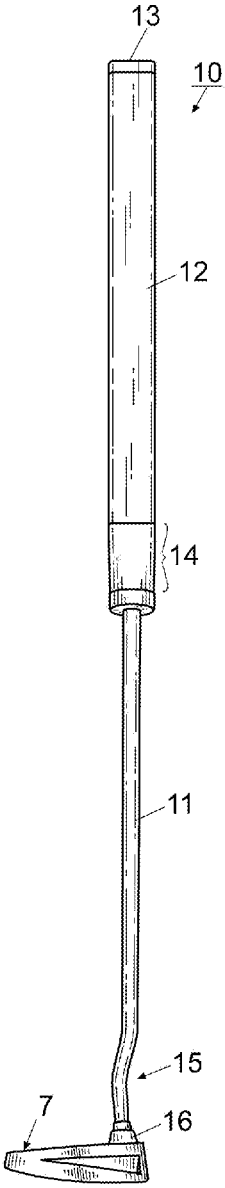
FIG. 6 features a left side elevational view of the putter as shown in FIG. 1.

To prevent drag of putter head 17 against the grass or other surfaces during putting, head 17 has an upward arcuate configuration as shown in FIGS. 5, 6 and 8. This upward angle 30 as illustrated in FIG. 8 may be, for example, preferably four (4) degrees from the horizon which provides an advantage on short putts as this gets the ball rolling quicker with less impact energy assisting the ball to hold the line better by creating a more instant roll. In an alternate embodiment, angle 30 may be changed, for example to two (2) degrees from the horizon which provides an advantage on longer putts as the contact angle created by angle 30 results in improved energy transfer to the ball without undue lifting which aids in aligning and hitting a true putt. Further, rear 26 of putter head 17 forms an arch 32 (FIG. 7) which extends substantially from side to side which not only keeps putter 10 from scuffing the ground during the stroke but also allows the club to change the face loft when it is laid back to address the ball. Arch 32 demonstrates the center decrease is material thickness with respect to rear 26 from the outer edges of toe 17 and heel 19 to the middle of arch 32. This redistribution of weight further adds to the perimeter weight, adding to putter 10 overall MCI.

In order to redistribute weight along the perimeter and improve putter head 17, ring 19 includes indents 34, 35 along the sides thereof proximate respectively toe 23 and heel 24. Ring 19 further includes cutout 37 between guides 25, 25' as shown in FIG. 7 to change the weight characteristics of putter head 17. Specifically, indents 34, 35 distribute the weight more evenly across flat top 18 and bottom 27 without adding weight through the middle of head 17. Preferred head 17 weighs at least six hundred (600) grams and has an outside width from toe 23 to heel 24 of approximately six and one-quarter inches (15.86 cm) across bottom 27, has an outside width from toe 23 to heel 24 of approximately six inches (15.24 cm) along top 18, a width of approximately five inches (12.7 cm) of face 20, a width from face 20 to rear 26 of approximately four inches (10.16 cm), a thickness from top 18 to bottom 27 of face 20 of approximately one inch (2.54 cm) and a thickness from top 18 to bottom 27 of rear 26 of approximately one half inch (1.27 cm) which produces the slopped sole for loft angle adjustment and ground clearance such as seen in FIGS. 7 and 8.

As shown in FIGS. 1-6, grip 13 defines a square shape and is formed from a resilient material which may be leather, rubber, or other polymeric materials that allow a player to securely hold the club in a comfortable grip in different weather conditions. Although capable of having a wide range of weights, preferred grip 13 weighs at least two hundred fifty (250) grams to serve as a stable platform for directing head 11 without requiring a golfer to physically exert himself during the putting stroke. The weight of grip 13 is approximately thirty three percent (33%) of the weight of head 17. Along with the weight of grip 12, the square design and overall length in combination with shaft 11 and head 17 produce a different design from previous clubs to provide for a more improved, better balanced putter 10.

Figure 9:
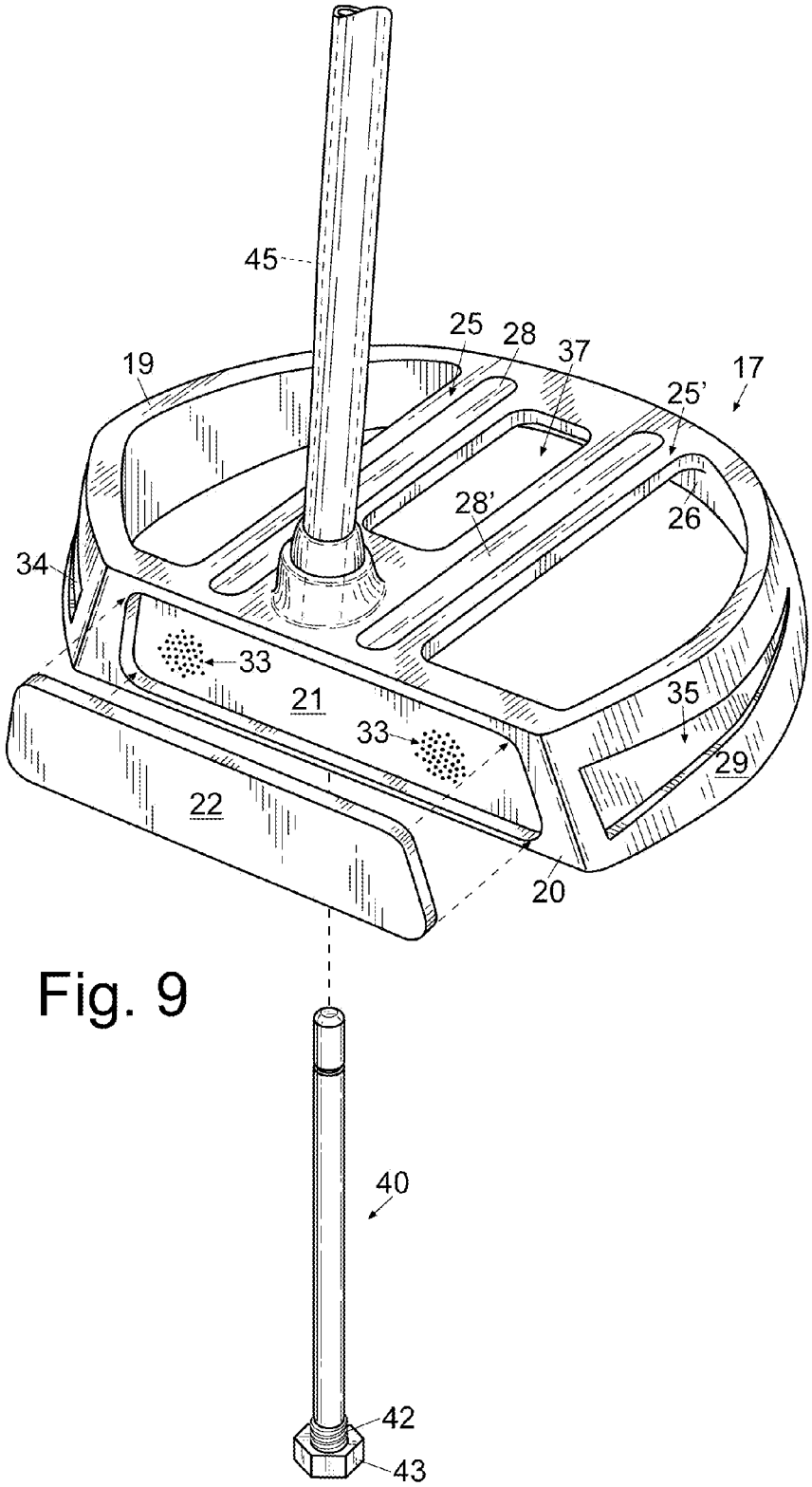
FIG. 9 depicts an enlarged perspective view of the putter head as shown in FIGS. 7 and 8 with the face plate and weighted member exploded therefrom.

As seen in FIG. 9 weight 40 is inserted through the bottom of club 10 into opening 41 (FIG. 3). Shaft 11 is hollow as seen by hollow section 45 in FIG. 9 for receiving weight 40 and includes threaded opening 41 for engagement with threads 42 of weight 40. Hexagonal head 43 allows for easy gripping by a wrench, pliers or the like. Weight 40 is disclosed in greater detail in my U.S. Pat. No. 7,922,600 incorporated herein by reference. Weight 40 can be exchanged, for longer or shorter weights, having more or less grams as desired by the individual user.

A preferred method of putting a golf ball including the steps of providing a ball and putter 10 having head 17 defining polygonal hollow ring 19 and grip 12 of resilient material with a square cross section extending approximately half the length of shaft 11 that defines a hollow section 45 and a weight opening 41 positioned near face 20, and striking the ball with face 20. The method may also include the steps of providing putter 10 further having ring 19 with flat top 18, flat face 20 with polymeric insert 22, and biased bottom 27 to form arcuate side 29 and rear 26 and providing face 20 having heel 24 and toe 23, heel 24 positioned at one end of face 20 and toe 23 positioned at the opposite end thereof with toe 23 having a length greater than heel 24. The method may further include the steps of providing shaft 11 having "S" shape bend 15, providing putter 10 with head 17 weighing at least 600 grams and grip 12 weighing at least 250 grams, and providing arcuate rear 26 that defines arch 32.

The illustrations and examples provided herein are for explanatory purposes and are not intended to limit the scope of the appended claims.

I claim:

1. A golf club, said club comprising a head, a shaft, a grip, said grip and said head attached at opposite ends of said shaft, said grip comprising a resilient material defining a square cross section, said grip extending approximately half the length of said shaft, said head defining a generally polygonal ring, said ring defining a flat top, a flat face, a biased bottom, an arcuate side, and an arcuate rear, and said flat face comprising a polymeric insert, said head defining a heel section and a toe section, said heel section positioned at one end of said head and said toe section positioned at an opposite end thereof, said toe section extending beyond said face a greater distance than said heel section.

2. The club of claim 1 wherein said grip weight is approximately thirty three percent (33%) of said head weight.

3. The club of claim 1 wherein said arcuate rear defines an arch.

4. The club of claim 1 further comprising a pair of guides, said pair of guides extending along the top of said head from said face to said rear of said head.

5. The club of claim 1 wherein said generally polygonal ring is substantially hollow with a pair of opposing side indents.

6. The club of claim 1 wherein said shaft defines a hollow section and a weight opening, said weight opening positioned proximate said face, a weighted rod, said weighted rod for inserting into said weight opening for placement within said hollow section.

7. The club of claim 1 wherein said shaft is smooth and defines an "S" shape.

8. The club of claim 7 wherein said head is offset from said grip.

9. A putter, said putter comprising a head, a shaft, said shaft defining an "S" shape, a grip, said grip and said head offset from one another and attached at opposite ends of said shaft to define a lie angle of approximately seventy four degrees (74°), said grip comprises a resilient material defining a square cross section, said grip extending approximately half the length of said shaft with a tapered bottom, said head defining a generally polygonal shaped hollow ring, said ring defining a flat top, a flat face, a biased bottom, an arcuate side, and an arcuate rear, said rear defining an arch, said flat face defining an indent for receiving a polymeric insert, said head defining a heel section and a toe section, said heel section positioned at one end of said head and said toe section positioned at an opposite end thereof, said toe section extending beyond said face a greater distance than said heel section, a pair of guides, said pair of guides extending from said face to said rear of said head, said shaft defining a hollow section and a weight opening, said weight opening positioned proximate said face, a weighted rod, said weighted rod for inserting into said weight opening for positioning within said hollow shaft section.

10. The putter of claim 9 wherein said grip weight is approximately thirty three percent (33%) of said head weight.

11. The putter of claim 10 further defining a rectangular cutout between said guides.

12. The putter of claim 10 further defining a three inch (3") sweet spot.

13. The putter of claim 12 whereby said face defines a width of five inches (5").

14. The putter of claim 13 whereby a majority of said sweet spot is positioned more proximate said toe than said heel.

15. A method of putting a golf ball comprising the steps of:

a) providing a ball and a putter with a head defining a generally polygonal hollow ring and a heel section and a toe section, the heel section positioned at one end of the head and the toe section positioned at an opposite end thereof, the toe section extending beyond a face a greater distance than the heel section, a shaft, a grip of resilient material defining a square cross section extending approximately half the length of the shaft, the shaft defining a hollow section and a weight opening positioned proximate a face; and b) striking the ball with the putter face.

16. The method of claim 15 wherein the step of providing a putter further comprises providing the ring with a flat top, a flat face with a polymeric insert, and a biased bottom to form an arcuate side and rear.

17. The method of claim 16 further comprising the step of providing an arcuate rear that defines an arch.

18. The method of claim 15 further comprising the step of providing a shaft defining a "S" shape.

19. The method of claim 15 wherein the step of providing a putter includes providing a putter with a head weighing in excess of 600 grams and a grip weighing in excess of 250 grams.

* * * * *